US007533622B1

(12) United States Patent
Jaszewski et al.

(10) Patent No.: US 7,533,622 B1
(45) Date of Patent: May 19, 2009

(54) PONTOON BOAT WITH POD CONTAINER ASSEMBLED FROM ABOVE DECK SURFACE

(75) Inventors: Wayne M. Jaszewski, Jackson, WI (US); George E. Phillips, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/973,571

(22) Filed: Oct. 9, 2007

(51) Int. Cl.
*B63B 1/00* (2006.01)

(52) U.S. Cl. ..... 114/61.1; 114/248

(58) Field of Classification Search ..... 114/259, 114/248, 77 R, 77 A, 221 R, 61.1; 440/54, 440/101

See application file for complete search history.

(56) References Cited

U.S. PATENT DOCUMENTS 1,754,983 A * 4/1930 Cumbo ..... 440/54
2,692,570 A * 10/1954 Costa ..... 114/77 A
3,659,546 A * 5/1972 Miklos ..... 114/246
4,075,971 A * 2/1978 Reginensi et al. ..... 440/54
4,678,439 A * 7/1987 Schlichthorst ..... 440/11
5,259,331 A 11/1993 Hagan ..... 114/61
5,911,187 A 6/1999 Sohm ..... 114/61
6,477,969 B2 11/2002 Schell-Tomczak et al. . 114/61.1
6,482,056 B1 11/2002 Schell-Tomczak et al. .... 440/53
7,182,033 B1 2/2007 Phillips et al. ..... 114/248
7,185,599 B1 3/2007 Griffiths et al. ..... 114/248
7,228,811 B2 6/2007 Huff et al. ..... 114/343

FOREIGN PATENT DOCUMENTS

JP 57007796 A * 1/1982

* cited by examiner

*Primary Examiner*—Ed Swinehart
(74) *Attorney, Agent, or Firm*—William D. Lanyi

(57) ABSTRACT

A container, or pod, is provided for a pontoon boat in which an engine is disposed within the container and the container is supported below the deck surface of the pontoon boat. The container is shaped to prevent its passing completely downwardly through an opening in the deck surface when it is assembled from a position above the deck. A marine propulsion device is connected to the engine which is located within the pod, or container, and extends from the container when the container and the marine propulsion device are supported below the deck of the pontoon boat.

15 Claims, 7 Drawing Sheets

PONTOON BOAT WITH POD CONTAINER ASSEMBLED FROM ABOVE DECK SURFACE

BACKGROUND OF THE INVENTION

1. Field of the Invention

The present invention is generally related to pontoon boats and, more particularly, to a marine propulsion system and associated container that can be assembled from a position above the deck surface of a pontoon boat and subsequently supported below the deck surface during operation.

2. Description of the Related Art

Many different types of pontoon boats are known to those skilled in the art. Some pontoon boats are provided with containers that are supported below the deck surface of the pontoon boat structure. These containers and/or marine propulsion support devices are typically assembled in a manner that requires the container to be attached to an underside of the deck surface.

U.S. Pat. No. 5,259,331, which issued to Hagan on Nov. 9, 1993, describes a motor pod for a pontoon boat. The pontoon boat is adapted to be propelled by an outboard motor. The boat has a deck and a pair of longitudinally extending parallel spaced apart pontoons depending from the deck and a means for mounting the outboard motor to the boat.

U.S. Pat. No. 5,911,187, which issued to Sohm on Jun. 15, 1999, describes a pontoon boat having a deck disposed over distal, watertight pontoons. Each pontoon comprises an elongated, generally cylindrical shell having a bow end consisting of an eccentric conical section extending upward at an angle out of the water. Splash rails, comprising fins protruding from the pontoon's shell, are disposed along the pontoon's inner and outer surfaces so that they extend substantially from the pontoon's bow end to its stern end.

U.S. Pat. No. 6,477,969, which issued to Schell-Tomczak et al. on Nov. 12, 2002, describes a boat with a center pontoon and separate motor mounts. A center pontoon for a pontoon boat provides improved performance and an adjustable engine mount. The adjustable engine mount makes it possible to adjust the relative position of an outboard engine relative to the water line of the boat.

U.S. Pat. No. 6,482,056, which issued to Schell-Tomczak et al. on Nov. 19, 2002, describes an engine mount. The mount is intended for use with a pontoon boat and makes it possible to adjust the relative position of an outboard engine relative to the water line of the boat. The mount has an elongated, tapered, four-sided body which is attached to the bottom of the hull of the boat by a pair of spaced apart, elongated mounting rails.

U.S. Pat. No. 7,182,033, which issued to Phillips et al. on Feb. 27, 2007, discloses a self-contained marine propulsion system for a pontoon boat. The device is disposed within a container, or pod, that is removably attachable to an undersurface of a deck of a pontoon boat. An engine is contained within the container and connected in torque transmitting relation with the marine propulsion device which can be a sterndrive device or a jet drive device. The marine propulsion system is dirigible, with a portion that is rotatable about a generally vertical steering axis and is supported by the container which is attached to the deck of the pontoon boat.

U.S. Pat. No. 7,185,599, which issued to Griffiths et al. on Mar. 6, 2007, discloses a jet drive propulsion system for a pontoon boat. A pontoon boat is provided with a jet drive propulsion system in which an impeller is driven by an engine. The jet drive propulsion device is dirigible as a result of the fact that a nozzle of the device is rotatable about a generally vertical steering axis. The jet drive device can be supported below a deck of a pontoon boat and located between two flotation tubes of the pontoon boat. Alternative locations can also be used, such as within the structure of the flotation tubes themselves.

U.S. Pat. No. 7,228,811, which issued to Huff et al. on Jun. 12, 2007, describes a multiply hinged sundeck for a pontoon boat. An engine compartment cover for watercraft incorporates first and second pivots. The cover can be rotated from an adjacent engine compartment in a first direction to a second location to provide a convenient axis to the engine from the stern of the watercraft. Alternately, a portion of the cover can be rotated in the opposite direction on the second pivot to provide access to the engine compartment from the deck of the craft.

The patents described above are hereby expressly incorporated by reference in the description of the present invention.

SUMMARY OF THE INVENTION

A pontoon made in accordance with a preferred embodiment of the present invention comprises a deck surface, an opening formed through the deck surface, a container configured to be supported below the deck surface, and an engine disposed within the container. The opening has a first support structure disposed at a periphery of the opening and the container has a second support structure attached proximate an upper portion thereof. The container is configured to permit it being lowered through the opening. The first and second support structures are configured to cooperate with each other to support the container in a position below the deck surface.

In certain embodiments of the present invention, the first support structure is a continuous flange extending around the periphery of the opening and the second support structure is a continuous flange extending around the periphery of the container proximate an upper portion thereof. An elastomeric seal can be provided and disposed between the first and second support structures. In addition, certain embodiments of the present invention can comprise a clamp member attached to the deck surface and configured to exert a clamping pressure on the second support structure between the clamp member and first support structure. A preferred embodiment of the present invention can further comprise a cover that is shaped to enclose the opening above the container. In certain embodiments of the present invention, it can further comprise a marine propulsion device attached to the engine, which is disposed within the container, and extending from the container. The first and second support structures, the container, and the opening are configured in a preferred embodiment of the present invention to permit the container to be lowered through the opening to a position below the deck surface with the first support structure being prevented from passing completely through the opening.

BRIEF DESCRIPTION OF THE DRAWINGS

The present invention will be more fully and completely understood from a reading of the description of the preferred embodiment of the present invention in conjunction with the drawings, in which.

DESCRIPTION OF THE PREFERRED EMBODIMENT

Figure 1:
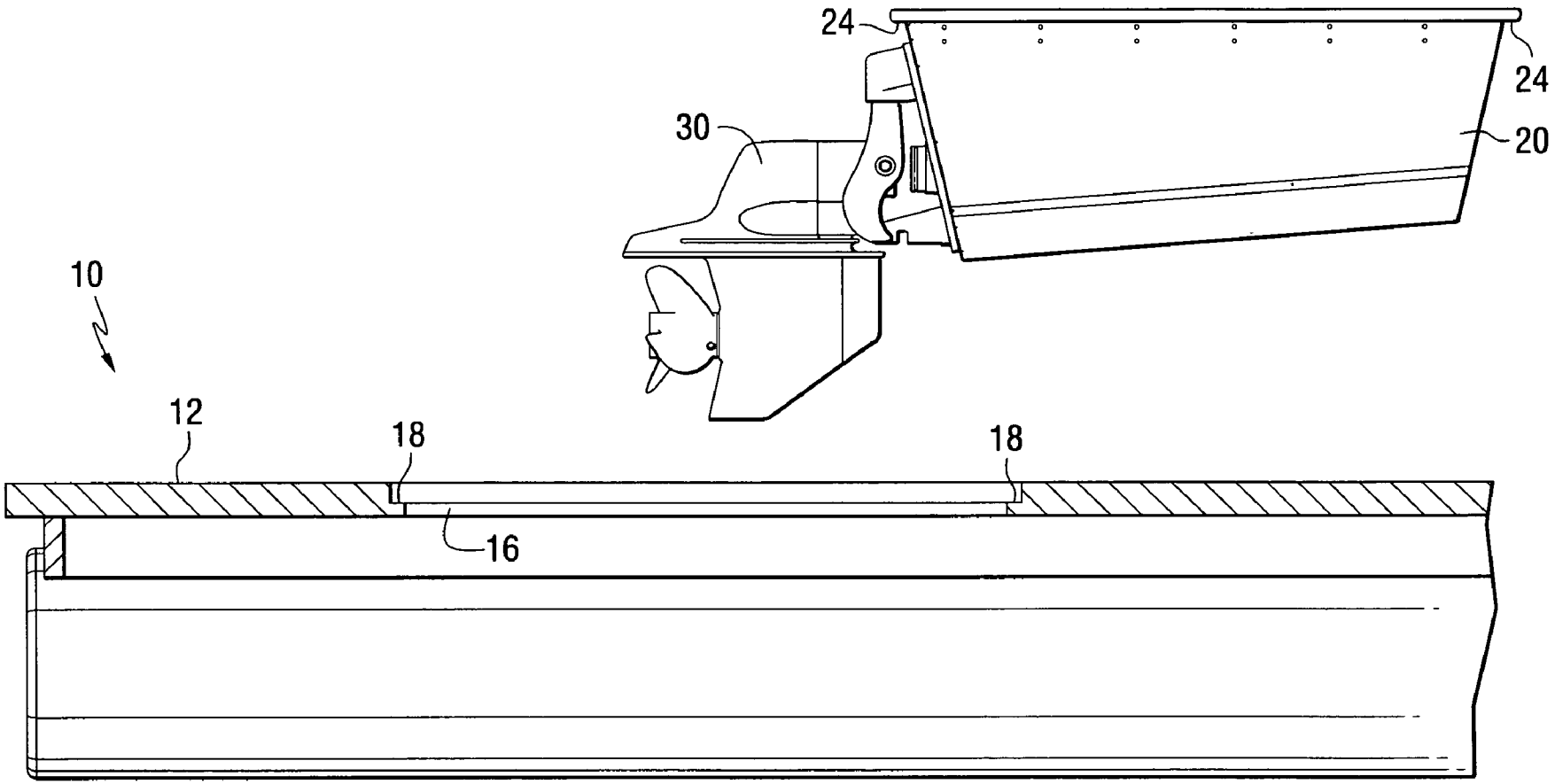
FIG. 1 is a side view of a container and marine propulsion device supported above a deck surface of a pontoon boat.

Throughout the description of the preferred embodiment of the present invention, like components will be identified by like reference numerals.

FIG. 1 shows a pontoon boat 10 having a deck surface 12. An opening 16 is formed through the deck surface 12. The opening 16 has a first support structure 18 disposed at a periphery of the opening. In the embodiment shown in FIG. 1, the first support structure 18 extends completely around the periphery of the opening 16 as will be described in greater detail below. A container 20 is configured to be supported below the deck surface 12, as will be also described below in greater detail. The container has a second support structure 24 that is attached proximate an upper portion of the container. The container is signed and configured to permit it being lowered through the opening 16. The first and second support structures, 18 and 24, are configured to cooperate with each other to support the container 20 in position below the deck surface 12. As will be described in greater detail below, an engine is disposed within the container 20 and, in certain embodiments of the present invention, a marine propulsion device 30 is attached to the engine and attached for support to the container 20.

Figure 2:
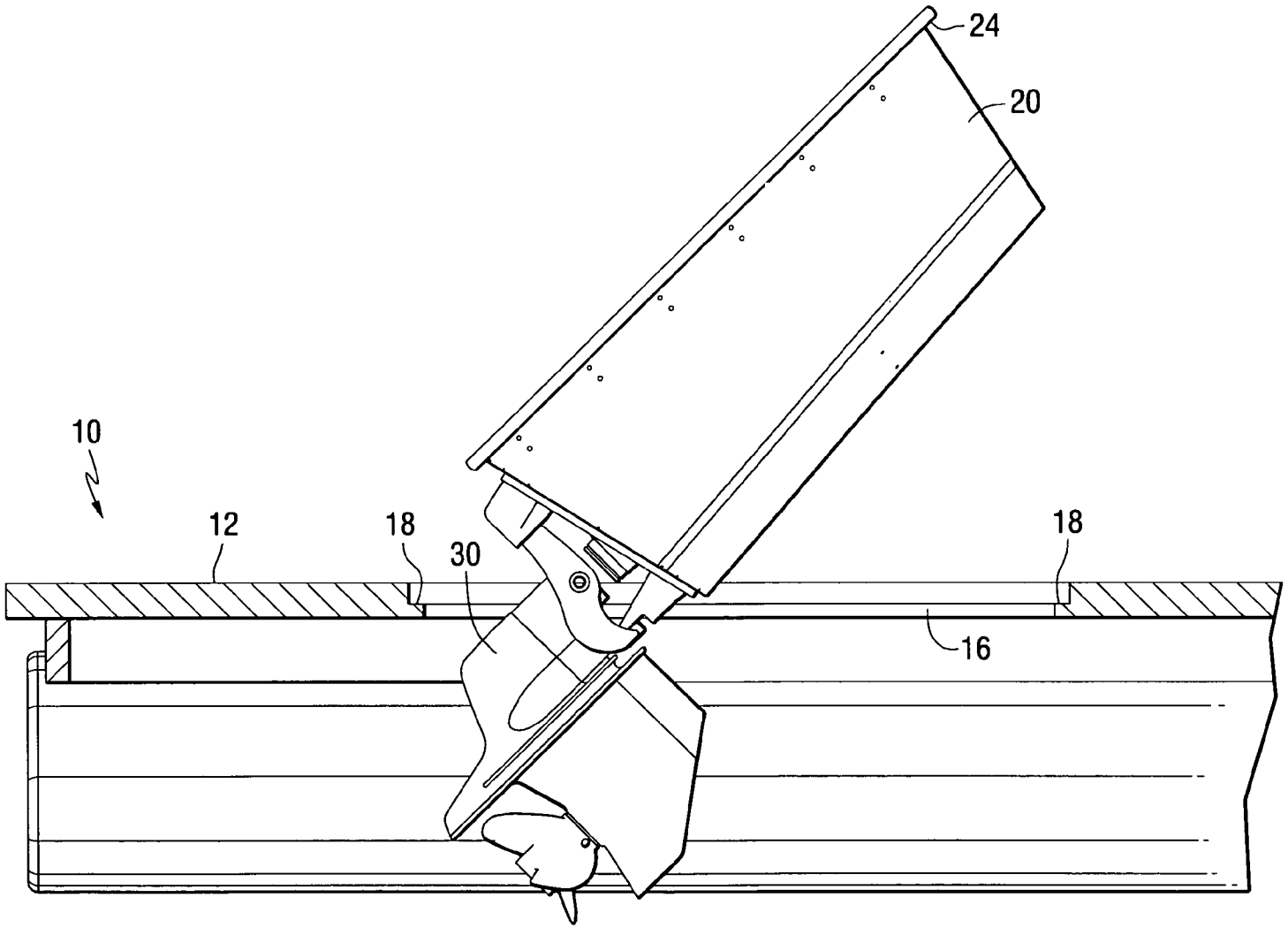
FIG. 2 shows the container tilted to allow the marine propulsion device and a majority of the container to pass downwardly through the opening in the deck of the pontoon boat.

FIG. 2 shows the container 20 during its assembly into and through the opening 16. With the exception of the second support structure 24, which can be a ledge around the periphery of the upper portion of the container 20, the marine propulsion device 30 and the body of the container 20 are shaped to be able to pass through the opening 16.

Figure 3:
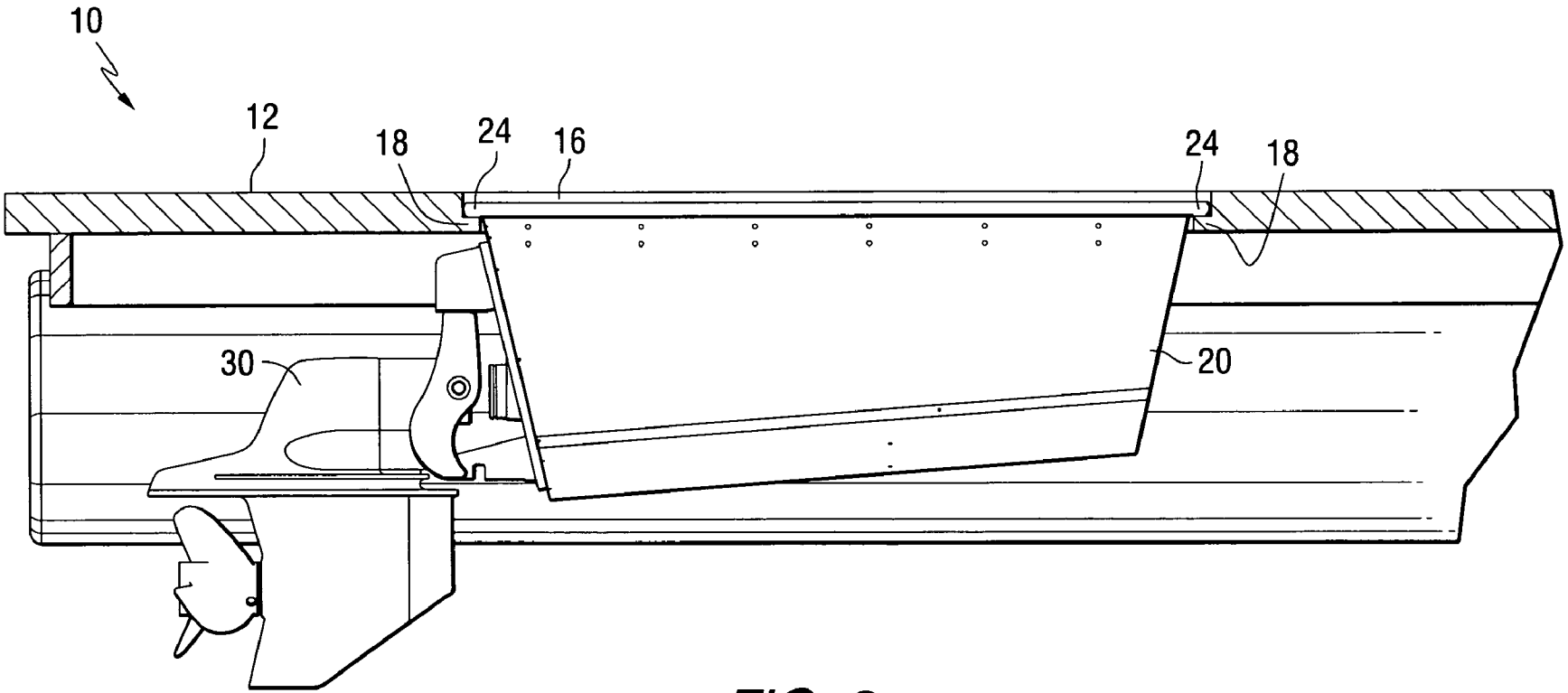
FIG. 3 shows the container in place below the deck surface of the pontoon boat and supported by first and second support structures.

FIG. 3 shows the container 20 supported below the deck surface 12 through the cooperation of the first and second support structures, 18 and 24. A marine propulsion device 30, which is connected to an engine within the container 20 and which is supported by the container, is shown below the deck surface 12. The cooperation of the first and second support structures, 18 and 24, prevent the entire container 20 from passing downwardly through the opening 16.

Figure 4:
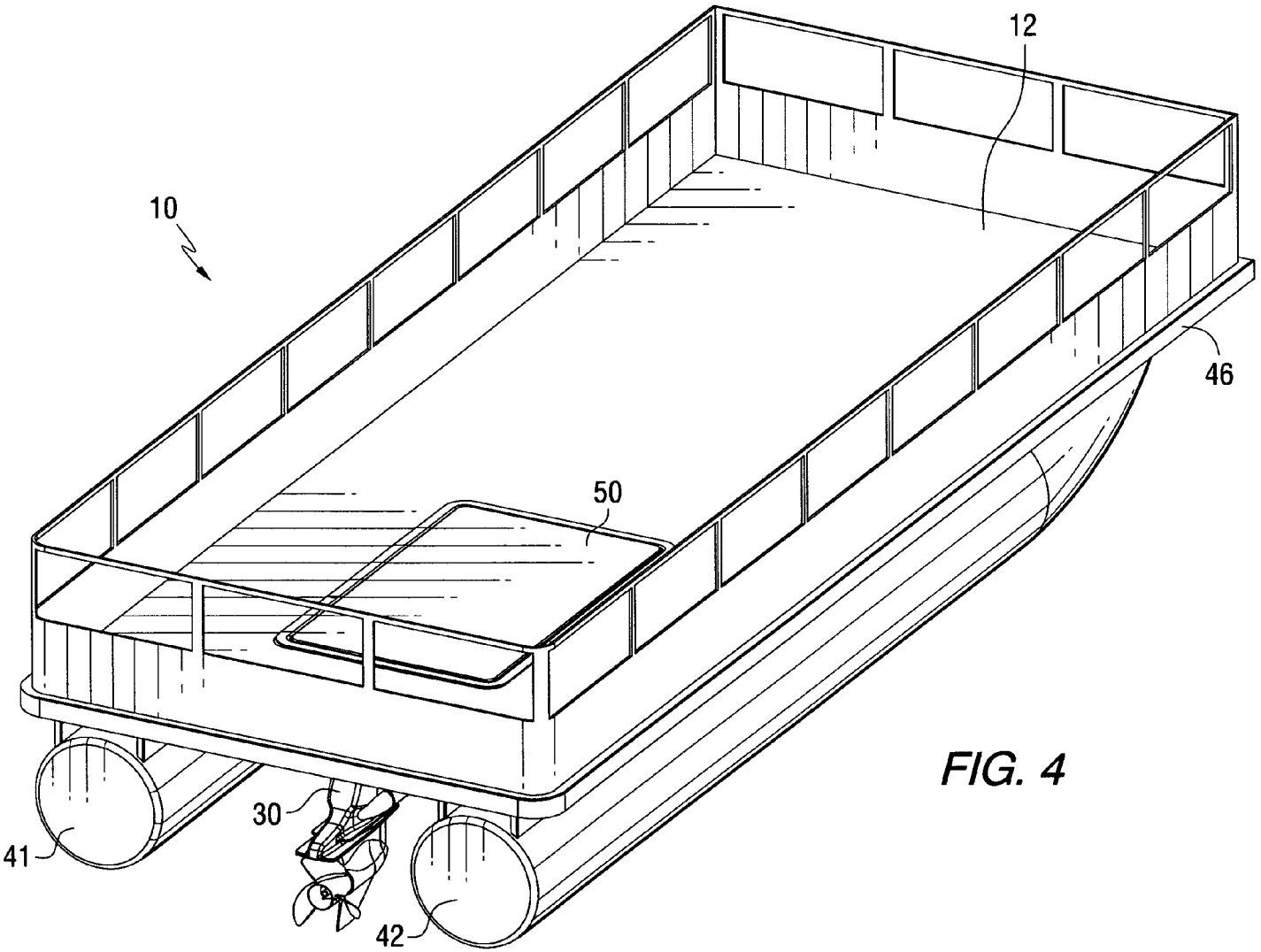
FIG. 4 is an isometric view of a pontoon boat incorporating a preferred embodiment of the present invention.

FIG. 4 is an isometric view of the pontoon boat 10 with two flotation devices, 41 and 42, attached below its deck structure. The marine propulsion device 30 is shown supported below the deck 46. A cover 50 is shown disposed over the opening 16 which is described above in conjunction with FIGS. 1-3.

Figure 5:
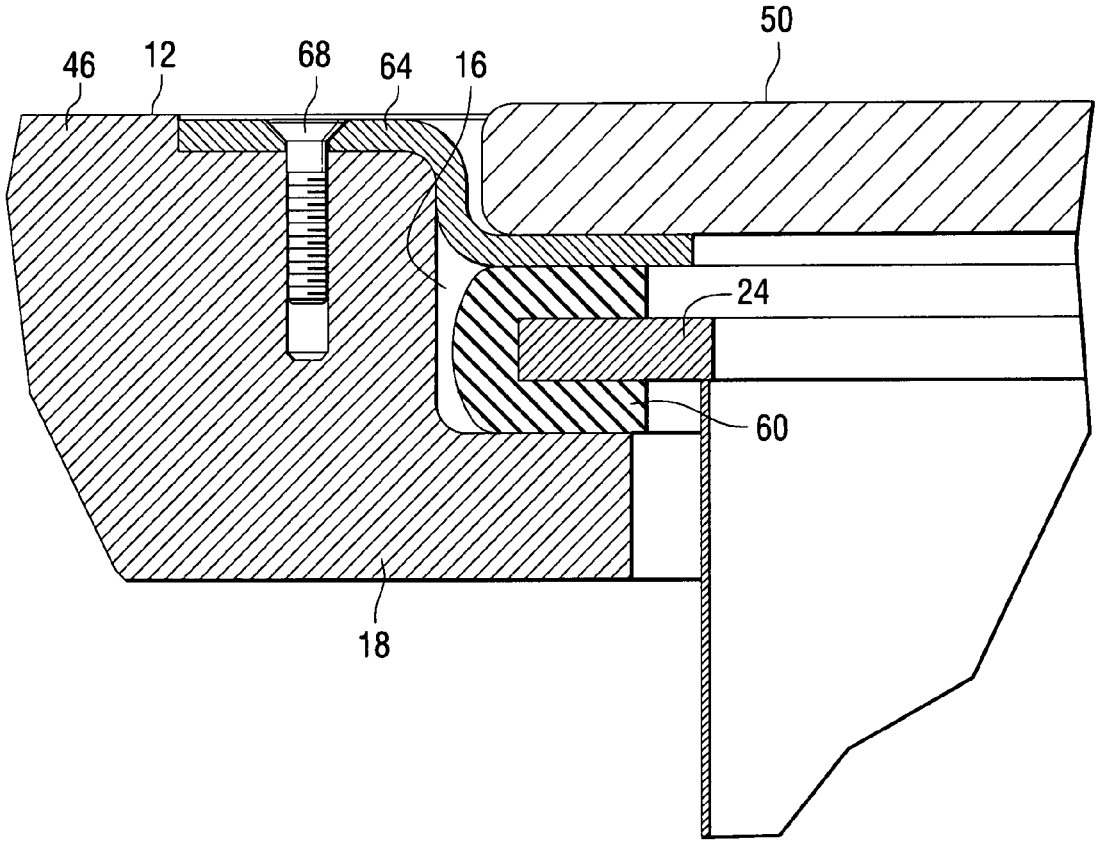
FIG. 5 is an enlarged view showing a sectioned illustration of the first and second support structures, an elastomeric seal, a clamp member, and a cover structure associated with the container.

FIG. 5 is an enlarged view of a portion of the interface between the first and second support structures, 18 and 24, along with the deck 46 and the upper deck surface 12. The cover 50 is shown in place over the opening 16.

With continued reference to FIG. 5, an elastomeric seal 60 is disposed around the edge of the second support structure 24 in order to prevent water from splashing upwardly from below the deck 46 to the region of the deck surface 12. A clamp member 64 is attached to the deck surface 12 and configured to exert a clamping pressure on the second support structure 24 between the clamp member 64 and the first support structure 18. This clamp member 64 also compresses the seal 60 and facilitates the prevention of water passing through the structure toward the upper deck surface 12. A plurality of screws 68 fastens the clamp member 64 to the deck 46. The clamp member 64 is shaped to receive the cover 50 in a recessed depression in order to cause the upper surface of the cover 50 to be generally co-planar with the upper deck surface 12.

Figure 6:
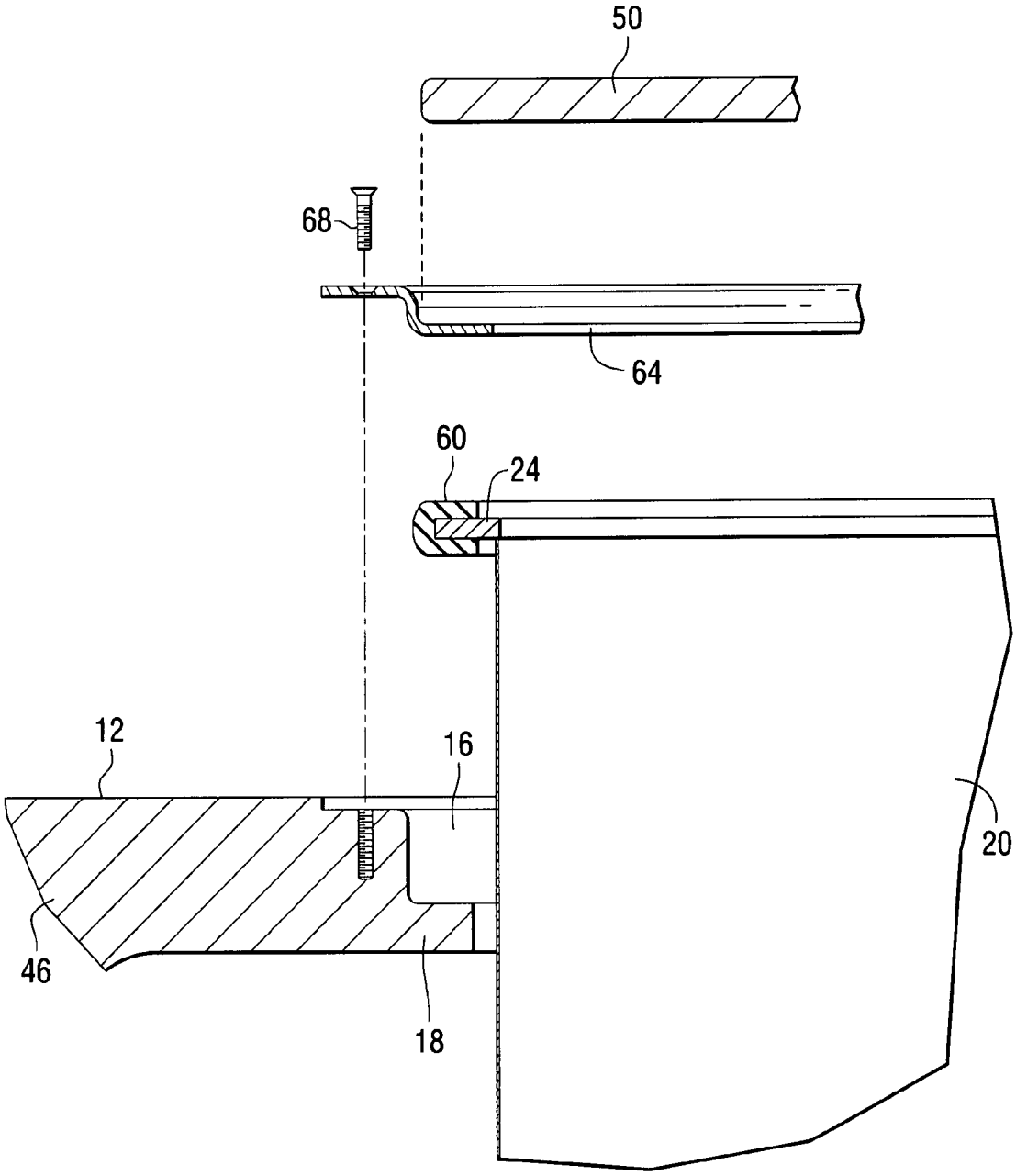
FIG. 6 is an exploded view of the illustration shown in FIG. 5.

FIG. 6 is an exploded view of the illustration shown in FIG. 5. As can be seen, the opening 16 is shaped to allow the second support structure 24 to move downwardly into the opening 16 and against the first support structure 18. This prevents the container 20 from passing completely through the opening 16 when it is assembled in the manner shown in FIGS. 1 and 2. The elastomeric seal 60 is disposed around the second support structure 24 and moves downwardly with the second support structure into the opening 16 in contact with the first support structure 18. The clamp member 64 is then lowered into the recessed portions formed in the deck in order to allow the clamp member to be generally flush with the upper deck surface 12. A plurality of screws 68 are used to fasten the clamp member 64 to the deck 46. The cover 50 is shown above the clamp member 64 and above the container 20 in FIG. 6.

Figure 7:
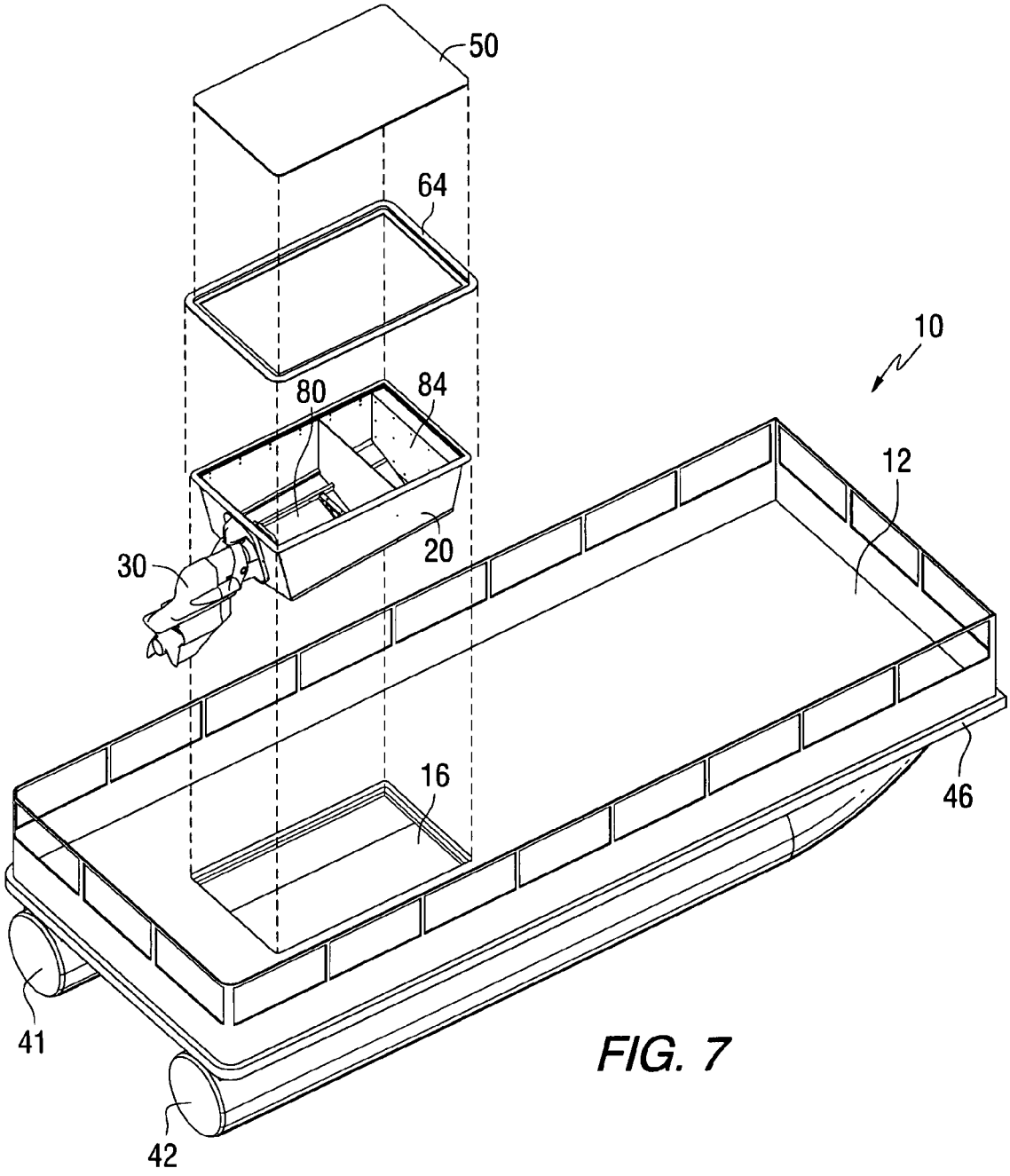
FIG. 7 is an exploded isometric view of a pontoon boat made in accordance with a preferred embodiment of the present invention.

FIG. 7 is an isometric exploded view of a pontoon boat 10 with the container 20 disposed above the deck surface 12 and above the opening 16 formed in the deck surface. The marine propulsion device 30 extends from the container 20 as shown in FIG. 7 and is connected to an engine 80. The container 20 can also provide a storage area 84 that can be used for storing liquid fuel. The clamp member 64 and the cover 50 are shown above the container 20. The deck 46 and pontoon members, 41 and 42, are well known structures to those skilled in the art. However, it should be understood that the container 20 and marine propulsion device 30 can be assembled to the deck 46 of the pontoon boat 10 from a position above the deck surface 12, unlike known types of marine propulsion devices for pontoon boats. The cooperation between the first and second support structures, 18 and 24, as described above in conjunction with FIGS. 1-6, prevents the container 20 from passing completely downwardly through the opening 16.

With continued reference to FIGS. 1-7, it can be seen that a pontoon boat made in accordance with a preferred embodiment of the present invention comprises a deck surface 12 at a top side of a deck 46, an opening 16 formed through the deck surface, a container 20 configured to be supported below the deck surface, and an engine 80 disposed within the container 20. The opening 16 has a first support structure 18 disposed at a periphery of the opening and the container 20 has a second support structure 24 attached proximate an upper portion thereof. The container 20 is configured to permit it being lowered through the opening 16. The first and second support structures, 18 and 24, are configured to cooperate with each other to support the container 20 in position below the deck surface 12. The first support structure 18 can be a continuous flange extending around the periphery of the opening 16 or, alternately, it can be intermittent flanges that are positioned and shaped to support the second support structure 24 of the container 20. The second support structure 24 of the container 20 can be a continuous flange extending around the periphery of the container proximate an upper portion thereof or, alternately, can be intermittent flanges extending from the upper portion of the container and configured to cooperate with the first support structure to maintain the correct position of the container with respect to the deck 46. An elastomeric seal 60 is disposed between the first and second support structures, 18 and 24, in a preferred embodiment of the present invention. The clamp member 64 is attached to the deck surface 12 and configured to exert a clamping pressure on the second support structure 24 between the clamp member 64 and the first support structure 18. A cover 50 is provided in certain embodiments of the present invention to enclose the opening 16. A marine propulsion device 30 is attached to the engine 80 and extends from the container 20 in a preferred embodiment of the present invention. The first and second support structures, 18 and 24, the container 20, and the opening 16 are configured to permit the container 20 to be lowered through the opening 16 to a position below the deck surface 12 with a second support structure 24 being prevented from passing completely through the opening 16.

Although the present invention has been described with considerable specificity and illustrated to show a particularly preferred embodiment, it should be understood that alternative embodiments are also within its scope.

We claim:

1. A pontoon boat, comprising:

an above-waterline deck surface supported on a pair of laterally spaced floatation pontoons;

an opening formed through said deck surface, said opening having a first support structure disposed at a periphery of said opening;

a container configured to be supported below said deck surface, said container having a second support structure attached proximate an upper portion thereof, said container being configured to permit it being lowered through said opening, said first and second support structures being configured to cooperate with each other to support said container in position below said deck surface;

an elastomeric seal disposed between said first and second support structures; and an engine disposed within said container.

2. The pontoon boat of claim 1, wherein:

said first support structure is a continuous flange extending around the periphery of said opening.

3. The pontoon boat of claim 1, wherein:

said second support structure is a continuous flange extending around the periphery of said container proximate an upper portion thereof.

4. The pontoon boat of claim 1, further comprising:

a clamp member attached to said deck surface and configured to exert a clamping pressure on said second support structure between said clamp member and said first support structure.

5. The pontoon boat of claim 1, further comprising:

a cover shaped to enclose said opening.

6. The pontoon boat of claim 1, further comprising:

a marine propulsion device attached to said engine and extending from said container.

7. The pontoon boat of claim 1, wherein:

said first and second support structures, said container, and said opening are configured to permit said container to be lowered through said opening to a position below said deck surface with said second support structure being prevented from passing completely through said opening.

8. A pontoon boat, comprising:

a deck having an upper surface;

an opening formed through said upper surface of said deck, said opening having a first support structure disposed at a periphery of said opening;

a container configured to be supported below said upper surface of said deck, said container having a second support structure attached proximate an upper portion thereof, said container being configured to permit it being lowered through said opening, said first and second support structures being configured to cooperate with each other to support said container in position completely below said upper surface of said deck;

an engine disposed within said container;

a clamp member attached to said deck and configured to exert a clamping pressure on said second support structure between said clamp member and said first support structure; and a marine propulsion device attached to said engine and extending from said container, said first support structure being a continuous flange extending around the periphery of said opening and said second support structure being a continuous flange extending around the periphery of said container proximate an upper portion thereof.

9. The pontoon boat of claim 8, further comprising:

an elastomeric seal disposed between said first and second support structures.

10. The pontoon boat of claim 8, further comprising:

a cover shaped to enclose said opening.

11. The pontoon boat of claim 8, wherein:

said first and second support structures, said container, and said opening are configured to permit said container to be lowered through said opening to a position completely below said deck with said second support structure being prevented from passing completely through said opening.

12. A pontoon boat, comprising:

an above-waterline deck having an upper surface and supported on a pair of laterally spaced floatation pontoons;

an opening formed through said deck, said opening having a first support structure disposed at a periphery of said opening;

a container configured to be supported below said deck, said container having a second support structure attached proximate an upper portion thereof, said container being configured to permit it being lowered through said opening, said first and second support structures being configured to cooperate with each other to support said container in position completely below said upper surface of said deck, said first and second support structures, said container, and said opening being configured to permit said container to be lowered through said opening to a position below said deck with said second support structure being prevented from passing completely through said opening;

an engine disposed within said container, said first support structure being a continuous flange extending around the periphery of said opening and said second support structure being a continuous flange extending around the periphery of said container proximate an upper portion thereof; and an elastomeric seal disposed between said first and second support structures.

13. The pontoon boat of claim 12, further comprising:

a clamp member attached to said deck and configured to exert a clamping pressure on said second support structure between said clamp member and said first support structure.

14. The pontoon boat of claim 13, further comprising:

a cover shaped to enclose said opening.

15. The pontoon boat of claim 14, further comprising:

a marine propulsion device attached to said engine and extending from said container.

* * * * *